US011904369B2

(12) United States Patent
De Kempe

(10) Patent No.: US 11,904,369 B2
(45) Date of Patent: Feb. 20, 2024

(54) APPARATUS AND METHODS USING THE APPARATUS FOR TREATING METAL WIRE

(71) Applicant: NV BEKAERT SA, Zwevegem (BE)

(72) Inventor: Geert De Kempe, Bruges (BE)

(73) Assignee: NV BEKAERT SA, Zwevegem (BE)

( * ) Notice: Subject to any disclaimer, the term of this patent is extended or adjusted under 35 U.S.C. 154(b) by 65 days.

(21) Appl. No.: 17/617,171

(22) PCT Filed: Jun. 26, 2020

(86) PCT No.: PCT/EP2020/067988

§ 371 (c)(1),
(2) Date: Dec. 7, 2021

(87) PCT Pub. No.: WO2021/001271

PCT Pub. Date: Jan. 7, 2021

(65) Prior Publication Data

US 2022/0324003 A1 Oct. 13, 2022

(30) Foreign Application Priority Data

Jul. 2, 2019 (EP) ..... 19183875

(51) Int. Cl.
*B21B 1/18* (2006.01)
*B21D 3/05* (2006.01)
(Continued)

(52) U.S. Cl.
CPC ..... *B21B 1/18* (2013.01)

(58) Field of Classification Search
CPC ..... B21B 1/18; B21F 1/02; B21F 1/04; B21F 1/004; B21F 23/00; B21D 3/02; B21D 3/05; B21D 1/02
(Continued)

(56) References Cited

U.S. PATENT DOCUMENTS 1,414,371 A 5/1922 Nilson
1,824,568 A 9/1931 Pierce
(Continued)

FOREIGN PATENT DOCUMENTS

DE 195 06 224 8/1996

OTHER PUBLICATIONS

International Search Report and Written Opinion of the International Searching Authority dated Oct. 5, 2020, in International (PCT) Application No. PCT/EP2020/067988.

*Primary Examiner* — Matthew Katcoff
*Assistant Examiner* — Mohammed S. Alawadi
(74) *Attorney, Agent, or Firm* — Wenderoth, Lind & Ponack, L.L.P.

(57) ABSTRACT

An apparatus for treating metal wire by multiple reverse bending and associated methods for using the apparatus are disclosed. The first roller has a first roller diameter, is followed by N−1 intermediate rollers with intermediate roller diameters and ends with an exit roller with an exit roller diameter. The exit roller is larger than the first roller and any one roller in the sequence of rollers has a roller diameter that is not smaller than the preceding roller in the sequence. The progressively larger diameters impose a well-controlled, gradually decreasing curvature to the wire resulting in a cast controlled wire. By folding the wire path together, a compact arrangement is obtained accommodating the increasingly larger rollers. A method to operate the apparatus is also described that allows for an easy adjustment of the apparatus in function of wire thickness.

11 Claims, 8 Drawing Sheets

(51) Int. Cl.
*B21F 1/00* (2006.01)
*B21F 23/00* (2006.01)

(58) Field of Classification Search
USPC ..... 72/16; 140/147
See application file for complete search history.

(56) References Cited

U.S. PATENT DOCUMENTS

| | | | | |
|---|---|---|---|---|
| 3,260,093 | A * | 7/1966 | Polakowski | B21D 1/05 72/163 |
| 4,612,792 | A | 9/1986 | De Bondt et al. | |
| 5,676,010 | A * | 10/1997 | College | B21D 3/05 72/162 |
| 2005/0166656 | A1* | 8/2005 | Romagnoli | B21F 1/02 72/160 |
| 2009/0282883 | A1* | 11/2009 | Noe | B21D 1/02 72/183 |

* cited by examiner

APPARATUS AND METHODS USING THE APPARATUS FOR TREATING METAL WIRE

TECHNICAL FIELD

The invention relates to an apparatus for treating metal wire by multiple reverse bending of the wire. Such apparatus is also commonly known as a 'wire straightener', 'straightener block', 'straightening device'.

BACKGROUND ART

Metal wires allow—due their elastic plastic behaviour—forming by stretching, bending and torqueing in almost any desired shape. However, before processing the wire to its final shape it is many times necessary to deliver the wire in a condition that allows this final processing.

In the case of for example nail stamping or spring forming the wire is first made straight in order to allow a precise entry into the machine. Not straight or bent wire can lead to misalignment and undesirable stops of the machine.

The wire shape is generally controlled by guiding the wire through a device called 'straightener'. Such a device is a series of equal diameter rollers that induce bends to the metal wire in consecutive opposite directions in a single plane as the wire is pulled through the device. The wire meanders through the rollers in a left-right-left-right- . . . bending sequence. By choosing the appropriate diameter of the rollers and carefully adjusting the indentation of the rollers, the outer fibres of the metal wire are brought into plasticity and the resulting 'cast' of the wire can be controlled. The 'cast' of a wire is the diameter of a loop of wire that is freely held on a horizontal plane without applying any forces (other than gravity). For a straight wire the cast is infinite. The 'indentation' of a straightener roll is the distance one roller enters over the tangent line of two adjacent rollers facing the one roller.

In the case of flat wires, cast control is crucial when producing flat wire for use as wind shield wiper arms or wind shield wiper blade reinforcement wire. In the case of round wires the multiple bends in a first plane are many times followed by the multiple bends in a second plane perpendicular to the first plane. Indeed, a straightener can only adjust the curvature of the wire in a single plane. It may be necessary to adjust the curvature also in the direction perpendicular to the first plane. Relevant prior art can be found in old (U.S. Pat. No. 1,414,371) as well as more recent (US 2005/0166656) publications.

Another use of devices imparting multiple reverse bends is to induce desirable residual stresses in the outer shell of the wire. Indeed by inducing more bending than is actually needed in order to shape the wire, compressive residual stresses can be induced in the outer shell of the wire. Compressive residual stresses prevent the propagation of cracks and therefore have advantageous effect on the fatigue life of metal wires such as for example the ones used in steel cord for the reinforcement of tires as demonstrated in U.S. Pat. No. 4,612,792.

Straighteners can also be used as 'flaw filters' in particular when combined with an axial tensile force. Due to the repeated bending and back bending of the wire any flaw due to a surface defect or an inclusion will lead to a rupture of the wire. Such 'filtering' of the wire is particularly important when the wire is to be used in critical applications, where a fracture of the wire leads to large damage, for example in the case of wire sawing. A fracture of a sawing wire can lead to damage that is a multiple of the cost of the wire and must therefore be avoided.

A further use of devices imparting multiple reverse bends is to obtain favourable mechanical properties on the wire. Indeed it is known for a long time from U.S. Pat. No. 1,824,568 that subjecting a steel wire, such as a bead wire, to multiple reverse bending results in a bead wire that is easier to form into a bead. A 'bead wire' is a steel wire that may or may not be brass or bronze coated that is used to coil 'beads'. A 'bead' is the annular reinforcement of a tire that holds the tire on the rim of the wheel. The result of the multiple reverse bends is that the yield strength of the wire is lowered. The yield strength is that stress at which the wire deviates from the linear Hooke behaviour in a stress-strain diagram. The yield stress is defined for a certain permanent elongation that is usually set to 2 parts in 1000 or 0.2% permanent elongation after removal of the load. A lowering of the yield stress makes the bead wire easier to deform into a coil.

The selection of number of rollers, the choice of the roller diameters in function of the wire diameter and the setting of the indentation of the rollers, offer a very large parameter space wherein the skilled person readily gets lost. Adjusting straighteners is therefore many times considered an art rather than science.

DISCLOSURE OF INVENTION

The object of the invention is therefore to reduce the complexity involved when adjusting straighteners or more generally apparatuses for treating metal wire by multiple reverse bending. It is a further object of the invention to reduce the number of adjustable parameters such that threading of the apparatus is simplified. It is a further object of the invention to obtain an apparatus that is applicable to a wide range of wire diameters without any adjustment of the apparatus. Two or more apparatuses can be combined to work together. Also an object of the invention is to provide a method to operate the apparatus.

According a first aspect of the invention an apparatus for treating metal wire according the preamble of claim 1 is provided. 'Metal wire' should be understood in its broadest possible meaning: any metal element or alloy of metal elements or a composite comprising predominantly metal can be regarded as 'metal wire'. Particular examples are copper wire, aluminium wire, brass wire, bronze wire and in particular steel wire. 'Steel' is a composite material of a known composition in the field that predominantly comprises iron with non-metal elements such as carbon, silicon, sulphur, nitrogen or phosphorus and metal elements such as manganese, aluminium, chromium, vanadium or any other element.

'Wire' is any elongated element that has a length that is much larger than any measure of the cross section of the wire taken perpendicular to that length direction. The wire may have a round cross section. Alternatively, the cross section of the wire may have a polygonal, rectangular, square, or round-flattened cross section. For the purpose of this application, the thickness 'd' of the wire is the smallest distance between parallel lines in a cross section perpendicular to the length dimension of the wire, the width 'w' of the wire is the largest distance between parallel lines in a cross section perpendicular to the length dimension of the wire. In other words: the thickness 'd' is the smallest calliper size and the width 'w' is the largest calliper size when measured in all directions around the wire. Wires have—for the purpose of this application—a width to thickness ratio ('w/d') that is smaller than 10 or even smaller than 8, 5 or 1.5. For a round wire the 'w/d' ratio is one and the thickness is called the diameter. In contrast therewith metal sheets have 'w/d' ratios that are far above 10. The bending behaviour of metal wires is different from that of metal sheets as the boundary conditions are totally different.

In the apparatus the metal wire is treated by 'multiple reverse bending' that is when travelling through the apparatus the wire is subjected to bends in alternate directions like left-right-left-right . . . or right-left-right-left . . . . One 'left-right' movement (or 'right'-'left' movement) corresponds to one reverse bending.

The apparatus comprises a first roller, a number of intermediate rollers and an exit roller that form a numerable sequence of rollers. So to every roller an index number can be given that is e.g. '1' for the first roller and 'N+1' for the exit roller, while the intermediate rollers may be indexed as ' ', '2', . . . to 'N'. The number of intermediate rollers 'N−1' is preferably one, or two, or three or any number up to and including eleven. Each of the rollers has a diameter specifically a first roller diameter, intermediate roller diameters and an exit roller diameter. The diameter of each roller is represented as Di, wherein 'i' is the index in the sequence. The rollers comprise a circumferential groove in which the metal wire is intended to run or to be received. The groove can have a rectangular shape—for processing flat wires—or a round cross section such as a U-groove or—more preferred—a V-groove. For the purpose of this application, with 'diameter of a roller' is meant the diameter of the roller taken at the bottom of the groove. All rollers are freely rotating and are not intentionally driven or restrained.

The rollers are mounted such that all grooves—more precisely the bottom of the grooves—remain in the same plane called the 'groove plane'. What is meant is that no roller is mounted more than one groove width out of this groove plane i.e. all groove bottoms can be found within plus or minus one groove width of the groove plane. Even more preferred is if all groove bottoms can be found within plus or minus one half groove width from the groove plane. Mounting rollers with grooves out of the groove plane may induce rotations into a round wire as it rolls to the bottom of the groove, which for this invention is not a preferred scenario.

The apparatus according the invention discriminates itself from the prior art wire straighteners in that the exit roller diameter is larger than the first roller diameter and in that any one roller in the sequence of rollers has a roller diameter that is not smaller than—i.e. is larger than or equal to—the diameter of the preceding roller in the sequence. If the one roller has the index 'i' in the sequence of rollers, the preceding roller has the index 'i−1'. In other words: the diameters of the rollers in the sequence are monotonically increasing from the first roller to the exit roller. Some of the intermediate rollers or the exit roller may have an equal diameter to the roller preceding it. Symbolically: $D_{N+1}>D_1$ and $D_i \geq D_{i-1}$ for i=2, . . . N+1.

The advantage of such an increasing roller diameter is that the curvature that is induced on the wire is controlled by the diameter of the rollers and not by the indentation of the rollers as will be explained later on.

In a preferred embodiment any one roller in the sequence of rollers has a roller diameter that is larger than the preceding roller in the sequence. In other words the diameters in the sequence of rollers is strictly monotonically increasing.

Symbolically: $D_{N+1}>D_1$ and $D_i>D_{i-1}$ for i=2, . . . , N, N+1.

In a further preferred embodiment, the ratio of the diameter of any one intermediate roller or exit roller to the diameter of the preceding roller in the sequence of rollers is between 1.00 and 2.00.

Symbolically: $1.00 \leq D_i/D_{i-1} \leq 2.00$ for i=2, . . . , N, N+1.

In a further preferred embodiment, the ratio of the diameter of any one intermediate roller or exit roller to the diameter of the preceding roller in the sequence of rollers is between 1.05 and 2.00.

Symbolically: $1.05 \leq D_i/D_{i-1} \leq 2.00$ for i=2, . . . , N, N+1.

In a further preferred embodiment, the ratio of the diameter of the intermediate roller following the first roller to the diameter of the first roller is between 1.05 to 1.20 or symbolically $1.05 \leq D_2/D_1 \leq 1.20$. That means that the diameter of the first intermediate roller must be between 5 and 20% larger than the diameter of the first roller.

The ratio between subsequent diameters of rollers may gradually grow toward the exit roller. Preferably the ratio of the diameter of the exit roller to the diameter of the roller preceding the exit roller in the sequence of rollers is between 1.2 and 2.0 or symbolically: $1.2 \leq D_{N+1}/D_N \leq 2.0$. Even more preferred is if this range is between 1.4 and 2.0. In any case it is preferred that the ratio of the rollers increases towards the exit of the apparatus.

For clarity: with 'in between X and Y' is meant 'in the range from X to Y, with the end values X and Y included'

The 'N+1' rollers each have an axis around which the rollers revolve and those axes are oriented perpendicular to the groove plane. The placement, the position of the axes perpendicular to the groove plane is such that an imaginary wire guided over the rollers can follow—meaning it is possible to construct—a meandering multiple reverse bending path. An imaginary wire has an infinitesimally small diameter, zero bending stiffness and infinite strength. In a meandering multiple reverse bending path the imaginary wire guided over the rollers alternatingly bends left-right-left-right . . . or equivalently right-left-right-left . . . when being pulled through and held taught in the sequence of rollers. In other words the bending direction in such path alternates from one roller to the next. Furthermore, the average of the absolute angles the imaginary wire subtends over the intermediate rollers is larger than 180°. This makes the path 'meandering'.

It is sufficient for the invention that at least one meandering multiple bending path can be constructed. The fact that such a meandering multiple bending path can be established for a particular arrangement of rollers does not exclude that a path can be constructed that is not a meandering multiple bending path in the meaning of this application in the same arrangement of the rollers. For example: it may remain perfectly possible to construct a path showing left-right-right-left-right . . . bending in an arrangement of rollers that allows at least one multiple bending path.

The meandering multiple reverse bending path comprises curved sections where the imaginary wire follows the groove in the rollers and completely adapts to the curve of the roller and straight sections where the imaginary wire does not touch the roller and follows a straight line.

In a particularly preferred embodiment the length of the straight sections following each one roller of the first roller and intermediate rollers in the meandering multiple reverse bending path is kept short and in any case shorter than the diameter of that one roller. Even more preferred is if the length of the straight section is shorter than three quarter, or even half, or a quarter of the diameter of the roller. The straight sections are to be kept as short as possible to prevent rotation of the wire when going from one bend direction to the other. Indeed, as the wire will resist the bending back, it will try to rotate. This must be prevented as much as possible.

The apparatus has an axis that corresponds to the tangent line to the circumferential groove of the first roller and the circumferential groove of the exit roller. If the total number of rollers 'N+1' is even, it is preferred that first and exit roller tangent the apparatus axis at opposite sides of the apparatus axis. Conversely, if the total number of rollers 'N+1' is odd, it is preferred that the first and exit roller tangent the apparatus axis from the same side of the apparatus axis.

As the diameters of the rollers multiplicatively increase towards the exit roller, the rollers quickly become large in diameter. Insertion of the apparatus into the wire path of a wire processing line then becomes problematic. However, the inventors suggest preferred arrangements wherein the distance (the 'Distance') along the apparatus axis from the tangent point of the first roller to the tangent point of the exit roller is smaller than the sum (the 'Sum') of the diameters of the intermediate rollers plus the radius of the first roller plus the radius of the exit roller. It is even more preferred if the Distance is smaller than 80% of the Sum, or even smaller than 70% of the Sum. The smaller the Distance is the shorter the apparatus can become.

In a further preferred embodiment the second roller and optionally even numbered rollers following in the sequence of rollers can be moved from a position at the one side of the apparatus axis to a position at the opposite side of the apparatus axis and vice versa. A roller is considered moved from the one side of the apparatus to the other side of the apparatus if at least the axis of the roller crosses the apparatus axis or even the whole roller is moved over the apparatus axis i.e. the axis is displaced over the diameter of the roller or more.

So for example the second roller only can be moved from one side of the apparatus axis to the other side. Or the second and fourth roller can be moved from one side of the apparatus axis to the other. Or the second, the fourth and the sixth roller can be moved from one side to the other and back. The further extension is clear to the skilled person.

The even numbered rollers may be individually or collectively moved wherein the former is more preferred. The individual steering of a single even numbered roller allows setting the apparatus for different wire diameter ranges automatically if the displacement of the even numbered rollers is driven. Such a modification may also greatly simplify the threading of the apparatus.

According a second aspect of the invention, a combination of two, three, four or more apparatuses according the first aspect of the invention has the following features:

- Each one of the two, three, four or more apparatuses have a groove plane;
- Each one of the two, three, four or more apparatuses have an apparatus axis corresponding to the tangent line to the circumferential groove of the first roller and the circumferential groove of the exit roller;

. . . that are combined in the following manner:

- All of the apparatus axes of the two, three, four or more apparatuses coincide i.e. all apparatuses share the one axis;
- The groove planes of the two, three, four or more apparatuses are pairwise different from one another. In other words: not one pair of the groove planes coincide and all planes cross one another along the one axis In a particular embodiment, the groove plane of the first apparatus can be considered as the 0° orientation, while the groove plane of the second apparatus makes an angle of 60° to the first and the third apparatus makes an angle of 120° to the first groove plane.

In a preferred embodiment the number of apparatuses is two and the groove planes are oriented perpendicular to one another. This bends the wire in the mutually orthogonal planes and in principle should be able to control the curvature of the wire in two planes.

According a third aspect of the invention a method to treat a metal wire by multiple reverse bending using the apparatus according to any one of the above described embodiments is presented. The wire is continuously dispensed from e.g. a spool or continuously provided by a previous wire treatment process. The wire has a thickness 'd'.

The metal wire is run through all or part of the rollers in the sequence of rollers in a multiple reverse bending path. The roller that first bends the wire will be called the entry roller. In any case the wire exits the apparatus by the exit roller i.e. the roller with the largest diameter. The metal wire can for example be first bent by the third roller in the sequence. In that case the third roller becomes the entry roller and the first roller and second roller remain idle and not used.

Specifically the ratio of the diameter $D_{entry}$ of the entry roller to the metal wire thickness 'd' or $D_{entry}/d$ is between 15 and 90, more preferred between 20 and 50, or between 35 and 50, such as between 35 and 45. This ratio is important as it sets the wire for the subsequent bends with lower radii of curvature.

During the processing the metal wire will contact a roller over a contact angle. The contact begins when the metal wire first touches the roller and ends when the metal wire disconnects from the contact roller. The contact angle is that angle centred at the centre of the roller spanning the arc of the metal wire that is in physical contact with the roller and follows the radius of the roller. A wire that is only tangent to the roller has a zero-contact angle.

In a subsequent preferred method the metal wire contacts any one of the intermediate rollers over a contact angle of between 15° and 90°. In a likewise preferred method each one of the intermediate rollers contacts the metal wire over an angle of between 15° and 90°.

In a more preferred method the sum of the absolute contact angles of all touching intermediate rollers is larger than 360°, or larger than 540°, or larger than 720°, 900° or even larger than 1080°. With 'absolute' is meant that any angle direction (left or right) is considered positive.

In another preferred method the metal wire contacts any one of the intermediate rollers over a contact angle of between 90° and 270°, or between 120° and 270° or even between 180° and 270°. Alternatively, each one of the intermediate rollers contacts the metal wire over an angle of between 90° and 270°, or between 120° and 270° or even between 180° and 270°.

Multiple bending paths with larger contact angles allow to design the apparatus more compact as the rollers can be threaded in an 'S' shaped, meandering manner.

In a further preferred method a combination of two, three, four or more apparatuses are used. In the method the metal wire is first multiple times In the method first the metal wire is reversibly bent multiple times in a first plane, followed by one, two, three or more multiple and reverse bends in one or more subsequent planes, said subsequent planes differing from the first plane, the subsequent planes being mutually differing from one another.

The method can be applied to any metal wire that can be plastically bend. Somewhat preferred ranges—but therefore not limiting the invention—are metal wires with a thickness of between 0.25 to 3.0 mm, for example between 0.5 and 2.0 mm. The method has been specifically designed to treat steel wire.

BRIEF DESCRIPTION OF FIGURES IN THE DRAWINGS

The hundred digit in the references of the figures refer to the figure number, while the ten and unit digit refer to corresponding items over the different figures. Throughout the figures the wire is depicted at its lowest possible position at the bottom of the groove of the rollers.

MODE(S) FOR CARRYING OUT THE INVENTION

Figure 1:
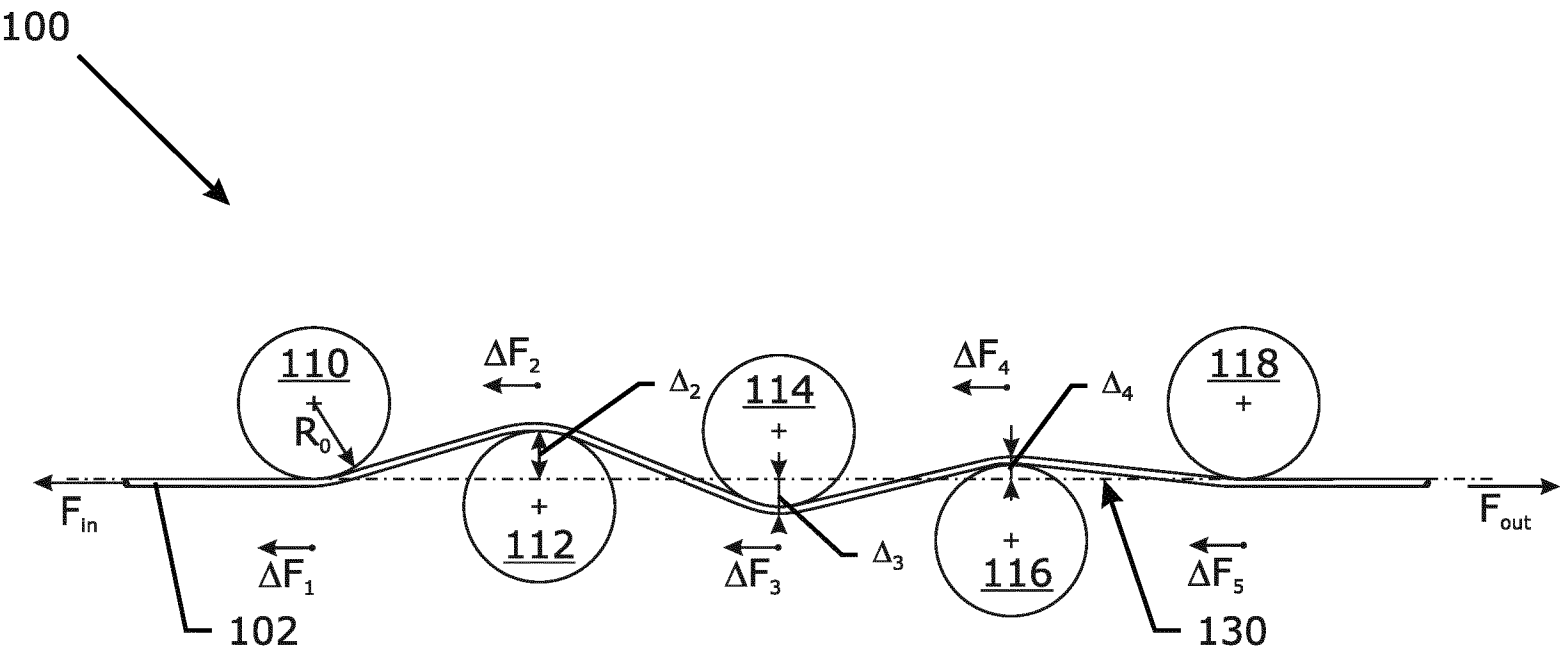
FIG. 1 shows an implementation of a prior art straightener threaded with a small diameter wire.
Figure 2:
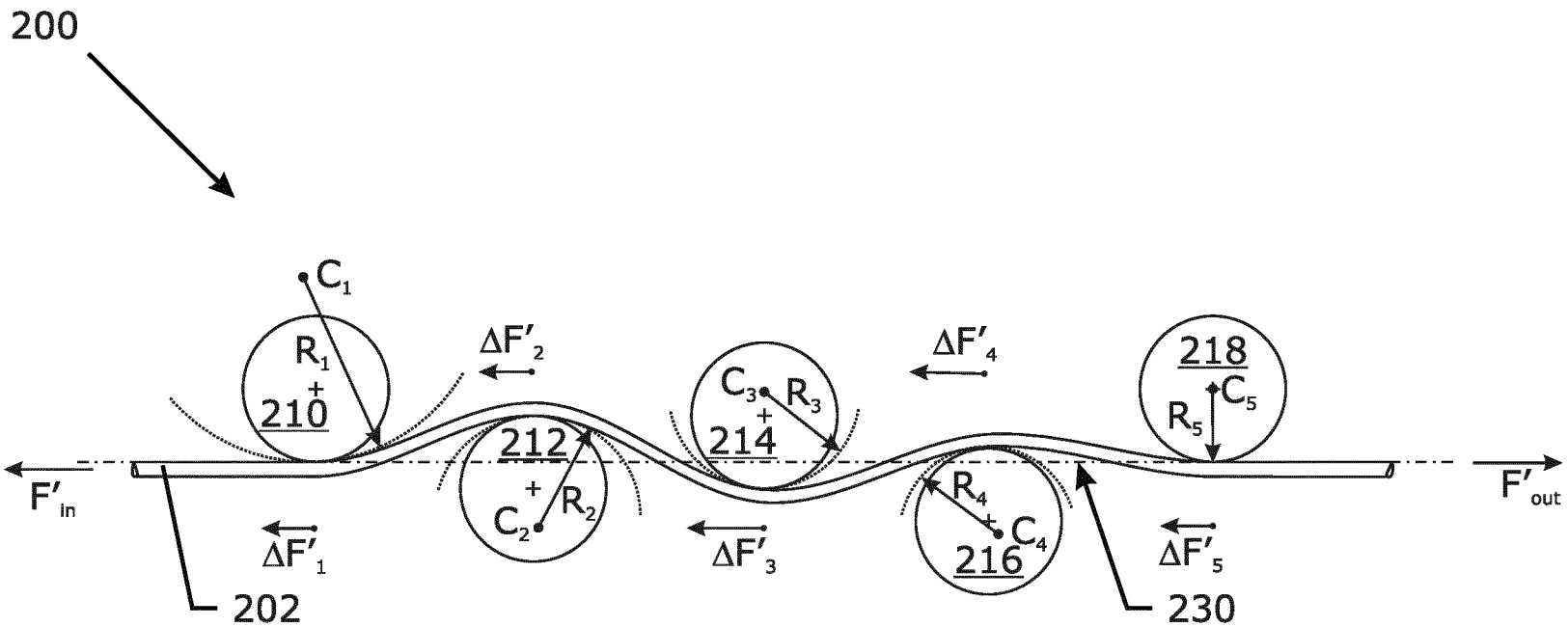
FIG. 2 shows an implementation of a prior art straightener threaded with a larger diameter wire.

In FIGS. 1 and 2 the problems with the prior art straighteners is illustrated. In FIG. 1 a straightener 100 with five rollers 110, 112, 114, 116, 118 is depicted that is wired with a small diameter wire 102. All rollers are provided with a groove through which the wire runs. All rollers have the same diameter. The wire is pulled through the device with a pull-through force '$F_{out}$' at speed V. The power needed to pull the wire through the straightener is '$F_{out}$ v'. At the entry a pull-back force '$F_{in}$' is applied to keep the metal wire in the straightener.

The radius $R_0$ shown is the radius of curvature taken by the metal wire as it passes the roller 110. In this case—as the wire diameter is small hence the bending stiffness is low—the wire accurately follows the curvature of all the rollers. The bending stiffness '(EI)' (in $Nmm^2$) of a wire is proportional to its material modulus 'E' (in $N/mm^2$) and the second axial moment of area 'I' (in $mm^4$) that for a round wire with diameter 'd' is equal to ($\pi d^4/64$). The bending of the wire to a radius of curvature $R_0$ takes energy hence each roller will add some pull-back force '$\Delta F_i$' to the entry pull-back force '$F_{in}$' making the pull-through force '$F_{out}$' bigger than the entry pull-back force '$F_{in}$'. Further, by increasing the indentation of the rollers '$\Delta_i$' (i=2, 3, 4) it is generally believed that more curvature is given to the wire. However, for a small wire diameter, with low bending stiffness, that touches the roller with diameter D over its contact angle the curvature applied will be 2/(D+d), irrespective of the indentation given to the roller.

When the metal wire is larger in diameter the situation changes to what is shown in FIG. 2. Again, the metal wire 202—with a larger diameter than metal wire 102—is guided in between opposed placed rollers 212, 216 against 210, 214 and 218. However, due to the increased bending stiffness '(EI)' of the wire ('I' scales with '$d^4$' !) the metal wire will not adopt the rounding of the radius of the rollers 210, 212, 214, 216 and 218 but rather its own radius of curvature indicated with $R_1$, $R_2$, $R_3$, $R_4$ and $R_5$ with a respective centre—not corresponding to the axis of the roller—$C_1$, $C_2$, $C_3$, $C_4$ and $C_5$.

Only when the tension on the wire is sufficiently large, a non-zero contact angle will form between the roller and the metal wire, hence the radius of curvature imposed on the metal wire will—over the contact angle touch path—be equal to the radius of the roller. Following classical Euler-Bernoulli elastic bending theory one can demonstrate that the minimum tension '$T_{min}$' (in N) required to have a non-zero contact angle is $T_{min} \geq EI/D^2$ with 'D' (in mm) being the diameter of the roller.

An obvious measure is then to increase the diameter of the rollers and to increase indentation in order to ensure the contact angle is non-zero. However, this has then also consequences on the pull-through force that on its turn influences the contact angle. The conclusion is that in a prior-art straightener, the amount of curvature given to the metal wire depends primarily on the local tension applied on the wire and the indentation given to the wire, variables that have mutual influence on one another and depends less on the diameter of the rollers. This at least for relatively thick wires. This makes the control of properties of wire exiting prior-art straighteners difficult.

In order to overcome this control problem the apparatus of the inventors starts from a different approach. Rather than controlling the applied curvature to the wire through tension, diameter of rollers and indentation, their idea is to keep the indentation constant and adapt the diameter of the rollers as the metal wire travels through the apparatus.

Figure 3:
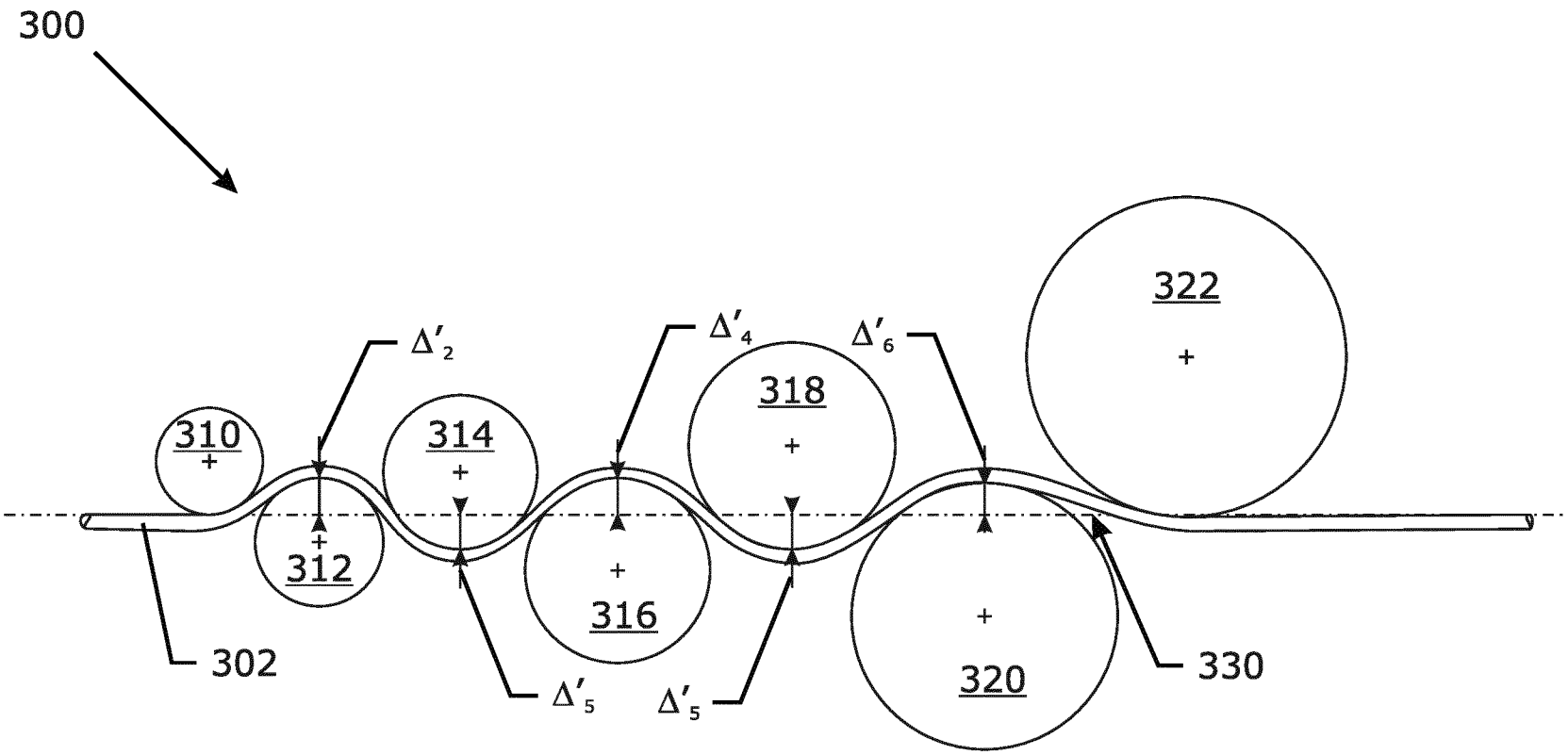
FIG. 3 shows a first embodiment of the inventive apparatus, threaded in a first way.

A first embodiment of this principle is depicted in FIG. 3. There the metal wire 302 is guided through a first roller 310, five intermediate rollers 312,314,316,318, 320 and an exit roller 322. Each of the rollers has a circumferential groove that is a rectangular groove in case of flattened wires or a V-groove of which the bottom radius of curvature is much smaller than half of the wire diameter in case of a round wire. The rollers have a diameter $D_i$ at the bottom of the groove, the entry roller 310 having diameter $D_0$ the exit roller 322 having diameter $D_6$. The grooves are all in one groove plane. The purpose of the groove is that it should prevent the wire from rotation when travelling from one roller to the next.

In the inventive apparatus the exit roller 322 is larger than the entry roller 310, and any one roller in the sequence of rollers has a roller diameter that is not smaller than the preceding roller in the sequence. Even more: any one roller in the sequence of rollers has a roller diameter that is larger than the preceding roller.

When wiring the apparatus, the roller of which the diameter $D_i$ is between 15 and 90 times the thickness of the metal wire 'd' is selected as the entry roller. Note that the entry roller need not be the same as the first roller. The ratio must be chosen so as to bring the outer fibres of the entering wire immediately into plasticity. For example a ratio of 40 brings an elongation to the outer fibres of the wire of 2.44% (100/41) and is for example for steel wires sufficient to bring the outer fibre into plasticity i.e. to impart a permanent bending to the wire.

The idea of the invention is that by putting the smallest roller at the beginning, the metal wire is plastically bent and given a predetermined amount of cast. This cast is in the subsequent rollers gradually increased by counter bending the metal wire over increasingly larger rollers. In this way the curvature given to the wire is stepwise driven near zero i.e. to an almost straight wire.

The ratio between the diameter of the roller 312 to the first roller 310 is between 1.05 and 1.20 for example 1.10. The ratio of the diameter of the exit roller 322 to the diameter of roller 320 is between 1.20 and 2.00 for example 1.90. The intermediate rollers have increasing diameters: the ratios of the intermediate rollers are $D_i/D_{i-1}$=1.20 ('i' now running from 2 to N−1).

The indentations $\Delta'_i$, i=2, 3, 4, 5 and 6 given to the wire are always the same and—for the purpose of the invention—is not a controllable parameter i.e. may be held fixed. Of course there must be some indentation to at least hold the wire in the grooves of the sequence of roller. The axes of the rollers (indicated with crosses '+' in the Figures) are oriented perpendicular to the groove plane. They are positioned such that a multiple reverse bending path forms with curved sections and straight sections as followed by the wire 302 in FIG. 3. The contact angles in this multiple reverse bending path are between 15° and 90°. Furthermore an axis 330 can be defined that corresponds to the tangent line to the circumferential groove of the first roller 310 and the circumferential groove of the exit roller 322.

Figure 4:
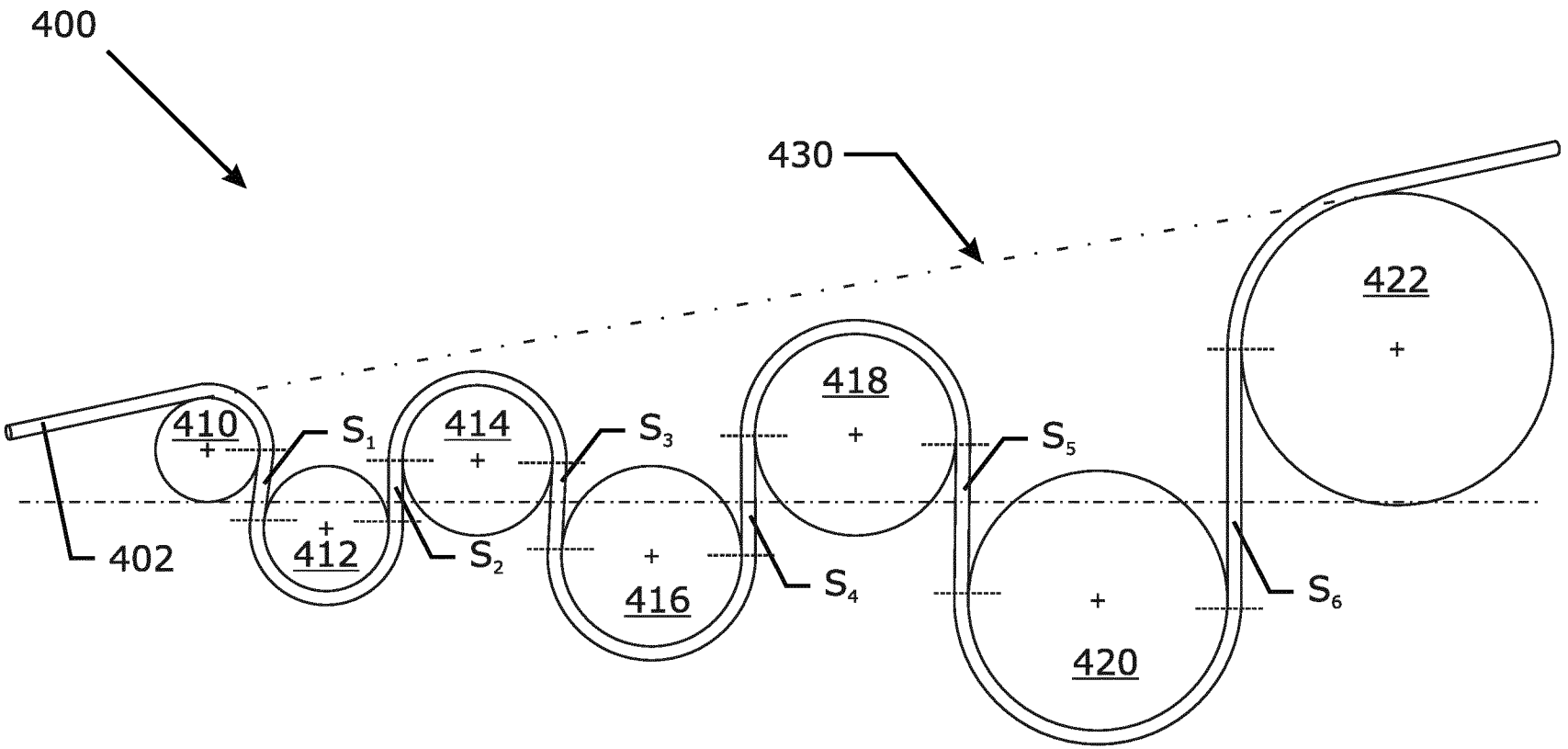
FIG. 4 shows the same embodiment of the inventive apparatus according FIG. 3, but threaded in second way.

In order to ensure a further increased contact angle between rollers and metal wire, the same apparatus as depicted in FIG. 3 can be threaded in a different way by selecting a meandering multiple reverse bending path, between the rollers ensuring that the contact angles to the intermediate rollers 412, 414, 416, 418 and 420 remain between 90° and 270° as is shown in FIG. 4. This path is a meandering multiple reverse bending path because the average absolute contact angle subtended over the intermediate rollers is larger than 180°. It remains important to reduce the straight sections $S_i$, i=1, 2, 3, 4, 5 and 6 as much as possible and to keep them in any case shorter than the diameter of the roller preceding the straight section. The reason for keeping the straight sections short is to prevent that the reverse bending of the following roller would make the metal wire rotate around its own axes.

Note that the axis of the apparatus is now 430 in FIG. 4. As the number of rollers is odd (seven) the exit roller 422 is situated at the same side of the apparatus axis 430 as the first roller 410.

Figure 5:
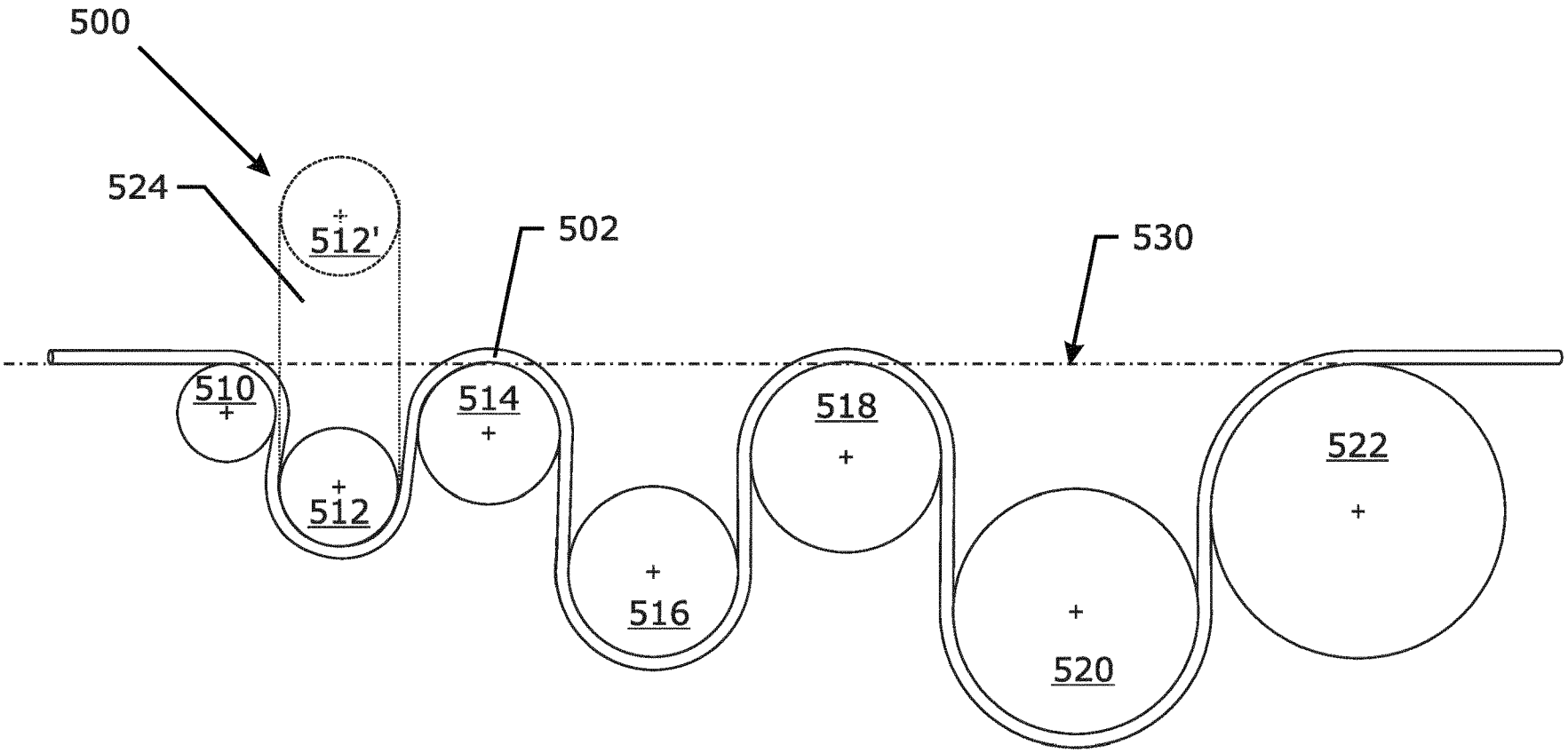
FIG. 5 shows an embodiment of the apparatus with a displaceable second roller in a first position with a threading for a fine diameter wire.

FIG. 5 illustrates the advantageous use of the second roller 512 that can be moved from one side of the apparatus axis 530 to the other side 512'. When processing small diameter wire, the wire must enter at a roller with a smaller size than when processing a thicker wire. By moving the roller 512 to the position at the same side of the first roller relative to the apparatus axis, the roller that first bends the wire 502 i.e. the entry roller becomes the first roller 510. So the entry roller is set to correspond to the first roller.

Figure 6:
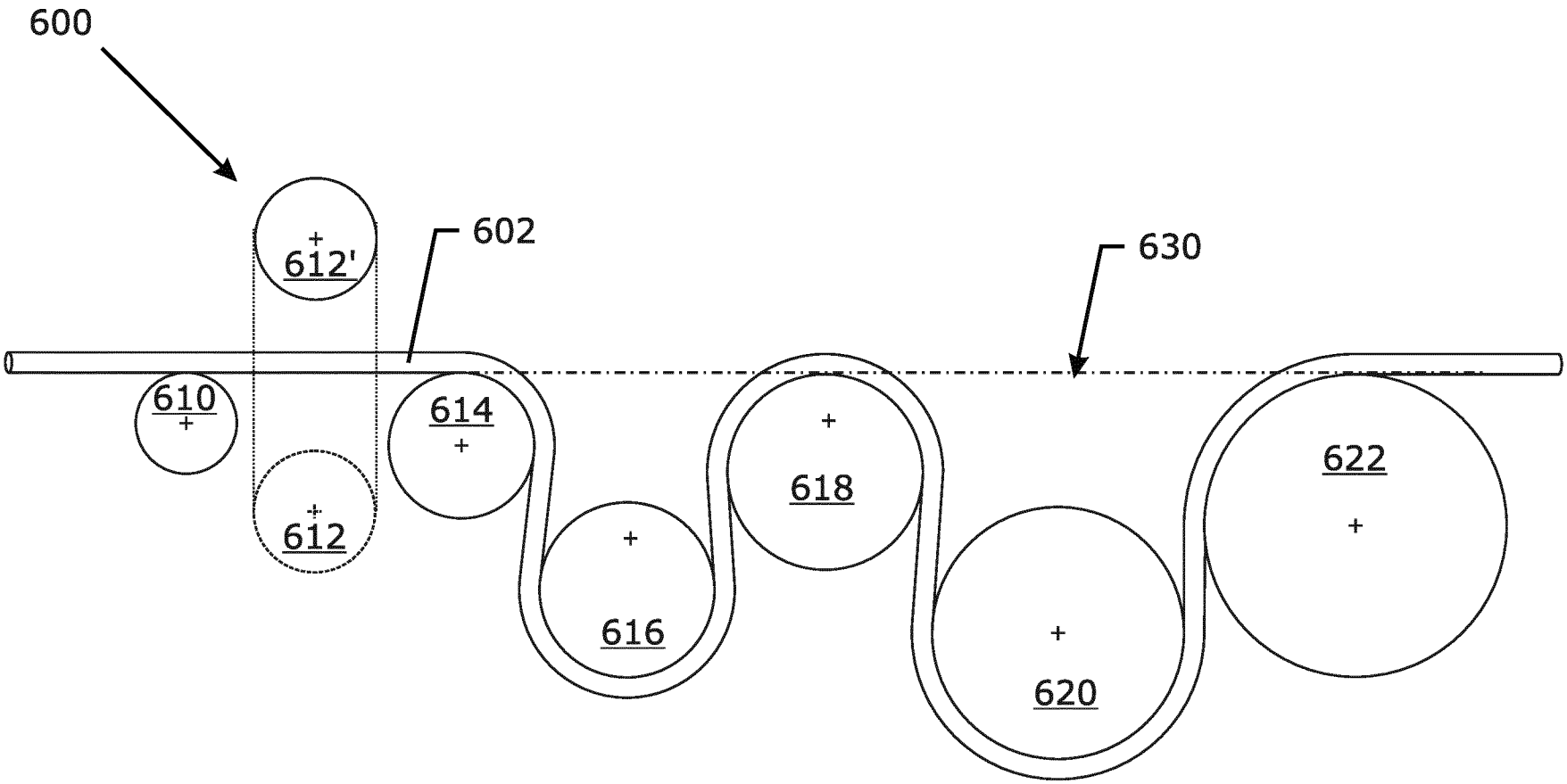
FIG. 6 shows an embodiment of the apparatus as in FIG. 5 wherein the second roller is moved into a second position to allow threading of a larger wire diameter.

When the apparatus is now to be used for a thicker wire 602—switching to FIG. 6—for which an entry roller with higher diameter is needed, the wire roller 612 is moved to the position opposite of the first roller indicated with 612' i.e. the second roller 612 is taken out of the wire path. Consequently, the roller 614—the third roller in the sequence of rollers—becomes the entry roller. As this roller 614 has a larger diameter it imposes the right elongation to the wire 602.

This feature makes the changeover from one diameter range to another diameter range particularly simple:

When a changeover from a thin to a thick wire is to be made, the wire end of the thin wire is welded to the start of the thick wire. Before the weld passes the apparatus, the apparatus is set from the situation of FIG. 5 to the situation in FIG. 6. The weld will pass without problem as it is not severely bent.

Mutatis mutandis when a changeover form a thick to a thin wire is to be made, the weld is first allowed to pass the apparatus before the situation is set from FIG. 6 to FIG. 5.

It will be clear to the skilled person how the feature of having a movable roller can be extended not only to the second roller 612 but also to the fourth roller 616 and so on.

Figure 7:
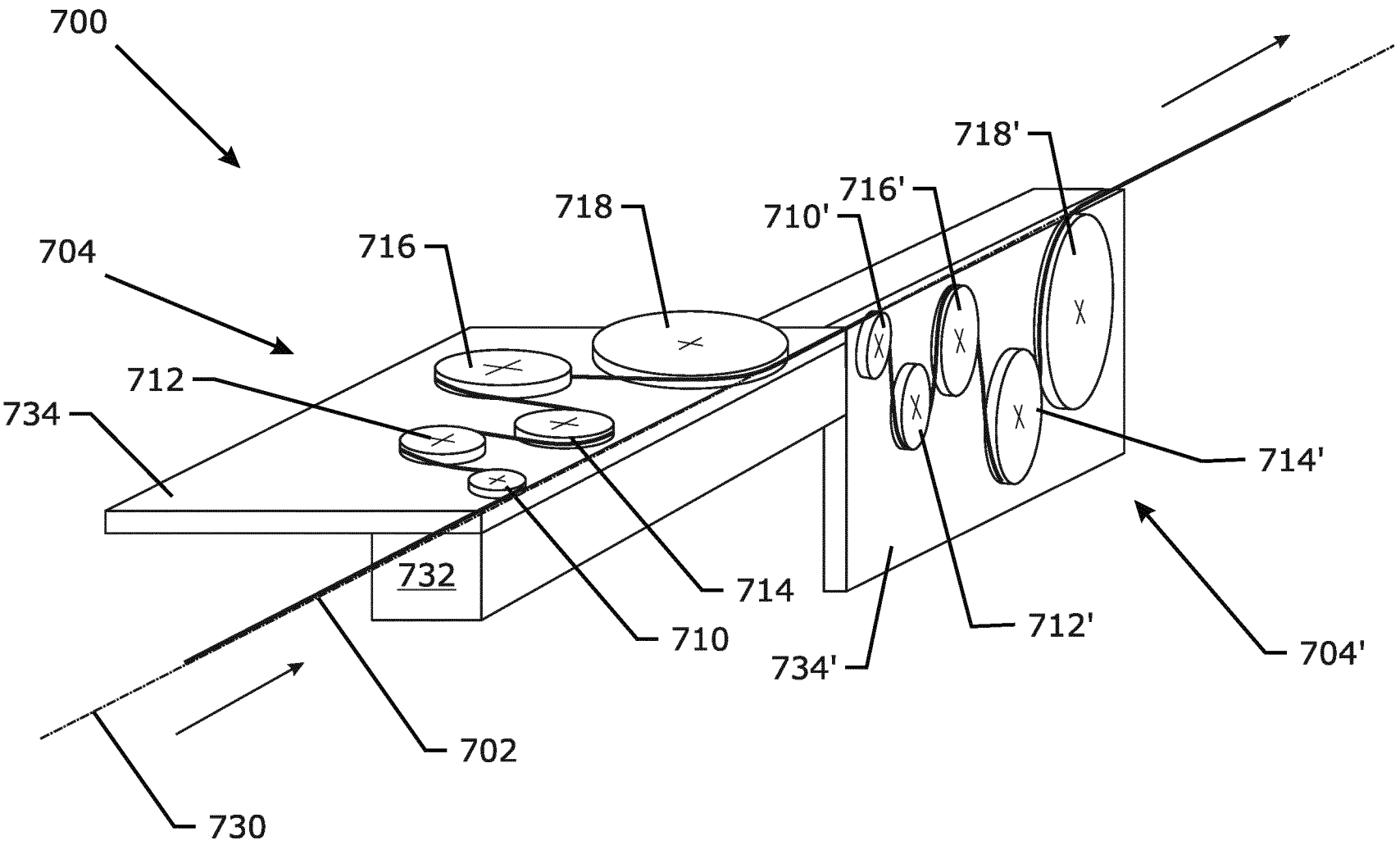
FIG. 7 shows a combination of the apparatus for multiple reverse bending in two directions.

FIG. 7 shows how a combination 700 of two apparatuses 704, 704' can be made. Two mounting plates 734, 734'—that are parallel to the groove planes of their respective apparatuses 704, 704' are mounted on a carrying beam 732. Both apparatuses 704, 704' share the same single axis 730 as the apparatus axis. Each of the apparatuses 704, 704' are provided with a sequence of rollers 710, 712, 714, 716, 718 and 710', 712', 714', 716', 718' that are pairwise equal. The wire 702 first enters the first apparatus 704 wherein it is multiple times reverse bent in the groove plane of 704. The wire 702 subsequently enters the second apparatus 704', wherein the wire is multiple times and reversibly bent in the direction orthogonal to the first direction.

It will clear to the skilled person that further multiple reverse bends can be induced in other directions by subsequent apparatuses in sequence.

Figure 8:
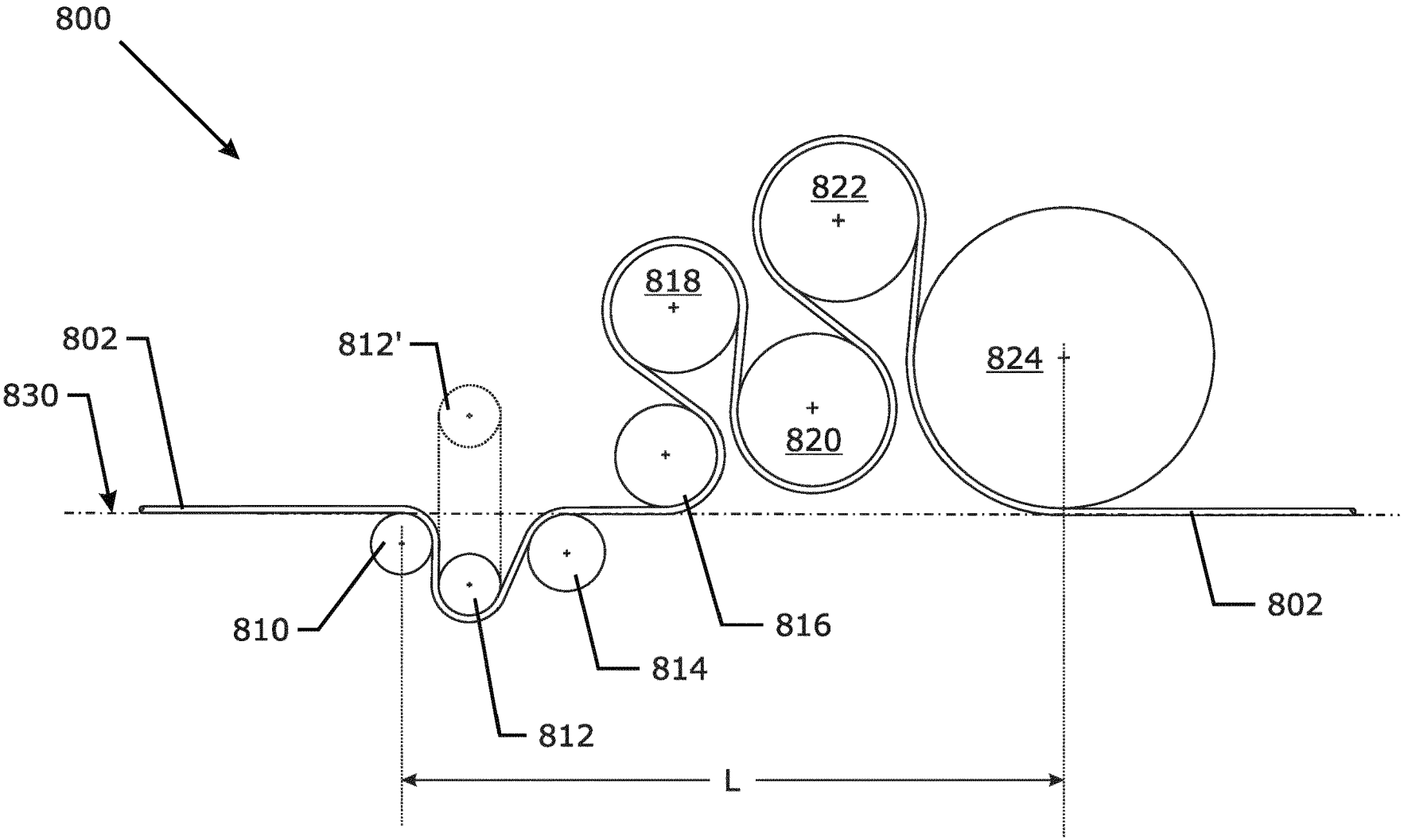
FIG. 8 shows an embodiment wherein many of the inventive features are combined.

FIG. 8 illustrates how the total length of the apparatus can be reduced. Positioning the axis of the rollers such that a highly meandering wire path is formed greatly reduces the overall length of the apparatus. The length of the apparatus is dimensioned based on the distance between the tangent points of the first roller 810 and the exit roller 824. Each of the intermediate rollers 812 to 822 have a diameter $D_i$, 1=1, 2, . . . to 6. When adding half the diameter i.e. the radius of 810 plus half the diameter of the exit roller 824 to all diameters of the intermediate rollers, the sum is larger than the length 'L'.

Further in FIG. 8 the total sum of the absolute contact angles to the intermediate rollers is about 1140°. Note that the roller 812 can be moved from a position at one side of the apparatus axis 830 to a position 812' at the opposite side of the apparatus axis;

The metal wire 302, 402, 502, 602, 702 or 802 can be any metal wire such as a flat or round copper, aluminium or steel wire with a thickness that is larger than or equal to 0.25 mm and smaller than 3.0 mm. A particular advantageous use of the apparatus and method is in the production of bead wire as used for making beads of tires. Also in the production of flat wires such as flat wires for use in wind shield wiper arms or flat wires that form the backbone of a wiper blade the apparatus is of use.

The invention claimed is:

1. A method of treating a metal wire by multiple reverse bending comprising the following steps:

providing an apparatus comprising a first roller having a first roller diameter, one or more intermediate rollers having intermediate roller diameters, and one exit roller having an exit roller diameter, wherein the first roller, the one or more intermediate rollers, and the exit roller form a sequence of rollers, wherein the first roller, the one or more intermediate rollers, and the exit roller each comprise a circumferential groove for receiving the metal wire, the circumferential groove being organized in one groove plane, wherein the exit roller diameter is larger than the first roller diameter, and wherein any one roller in the sequence of rollers has a roller diameter that is not smaller than a preceding roller in the sequence of rollers;

continuously providing the metal wire having a metal wire thickness and a metal wire width, wherein the metal wire thickness is a smallest calliper size and the metal wire width is a largest calliper size when measured in all directions perpendicular to the metal wire, and wherein a ratio of the metal wire thickness to the metal wire width is smaller than 10; and running the metal wire through all or part of the sequence of rollers in a multiple reverse bending path from an entry roller to the exit roller, wherein the entry roller is the roller of the apparatus that that first bends the wire, wherein the entry roller is selected such that a ratio of a diameter of the entry roller to the metal wire thickness is between 20 and 50.

2. The method according to claim 1, wherein the metal wire contacts the one or more intermediate rollers over a contact angle centered at the axis of the one or more intermediate roller, a sum of the absolute contact angles being larger than 360°.

3. The method according to claim 2, wherein the metal wire contacts any of the one or more intermediate rollers over a contact angle centered at the axis of the one roller, the contact angle being between 90° and 270°.

4. The method according to claim 1, wherein the apparatus is a combination of two, three, or more apparatuses, each of the apparatuses having a groove plane, each one of the apparatuses having an apparatus axis corresponding to the tangent line to the circumferential groove of the first roller and the circumferential groove of the exit roller, all of the apparatus axes of the two, three, or more apparatuses coinciding to one another, wherein the groove planes of the two, three, or more apparatuses are pairwise different from one another, and wherein the metal wire is treated in the combination of apparatuses, wherein first the metal wire is reversibly bent multiple times in a first plane, followed by one or more multiple and reverse bends in one or more subsequent planes, the subsequent planes differing from the first plane, the subsequent planes mutually differing from one another.

5. The method according to claim 1, wherein the mthickness is larger than or equal to 0.25 mm and smaller than or equal to 3.0 mm.

6. The method according to claim 1, wherein the metal wire is a steel wire.

7. The method according to claim 1, wherein the axis of the first roller, the one or more intermediate rollers, and the exit roller are oriented perpendicular to the groove plane, the first roller, the one or more intermediate rollers, and the exit roller being positioned in the groove plane, wherein the metal wire guided over the first roller, the one or more intermediate rollers, and the exit roller forms a meandering multiple reverse bending path comprising curved sections and straight sections, and wherein a straight section follows the meandering multiple reverse bending path after each roller of the first and intermediate rollers in the sequence of rollers, the length of the straight section being shorter than the diameter of that roller.

8. The method according to claim 1, wherein any one roller in the sequence of rollers has a roller diameter that is larger than the preceding roller in the sequence of rollers.

9. The method according to claim 1, wherein the ratio of the diameter of any one intermediated roller or the exit roller to the diameter of the preceding roller in the sequence of rollers is between 1.00 and 2.00.

10. The method according to claim 1, wherein the ratio of the diameter of the intermediate roller following the first roller to the diameter of the first roller is between 1.05 and 1.20.

11. The method according to claim 1, wherein the ratio of the diameter of the exit roller to the diameter of the roller preceding the exit roller in the sequence of rollers is between 1.2 and 2.0.

* * * * *